US007386361B2

(12) United States Patent
Nobuyuki et al.

(10) Patent No.: US 7,386,361 B2
(45) Date of Patent: Jun. 10, 2008

(54) EMBROIDERY DATA CREATION DEVICE, EMBROIDERY DATA CREATION METHOD, AND EMBROIDERY DATA CREATION PROGRAM

(75) Inventors: Takeuchi Nobuyuki, Wakayama (JP); Okubo Atsushi, Wakayama (JP); Nishioka Hisataka, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 57 days.

(21) Appl. No.: 10/575,787

(22) PCT Filed: Sep. 9, 2004

(86) PCT No.: PCT/JP2004/013108

§ 371 (c)(1),
(2), (4) Date: Apr. 14, 2006

(87) PCT Pub. No.: WO2005/038118

PCT Pub. Date: Apr. 28, 2005

(65) Prior Publication Data

US 2007/0129840 A1 Jun. 7, 2007

(30) Foreign Application Priority Data

Oct. 15, 2003 (JP) ..... 2003-355163

(51) Int. Cl.
*D05C 5/02* (2006.01)

(52) U.S. Cl. ..... 700/138; 700/136; 112/470.04; 112/475.17; 112/475.18

(58) Field of Classification Search ..... 700/130, 700/136, 138; 112/470.04, 475.17, 475.18, 112/475.19
See application file for complete search history.

(56) References Cited

U.S. PATENT DOCUMENTS

| | | | | | |
|---|---|---|---|---|---|
| 4,429,364 | A | * | 1/1984 | Maruyama et al. | 700/137 |
| 4,622,907 | A | * | 11/1986 | Kimura | 112/102.5 |
| 4,742,786 | A | * | 5/1988 | Hashimoto et al. | 112/102.5 |
| 4,849,902 | A | * | 7/1989 | Yokoe et al. | 112/470.04 |
| 4,998,489 | A | * | 3/1991 | Hisatake et al. | 112/103 |
| 5,005,500 | A | * | 4/1991 | Kato et al. | 112/102.5 |
| 5,255,198 | A | * | 10/1993 | Yokoe et al. | 700/138 |
| 5,282,142 | A | * | 1/1994 | Asano | 700/138 |
| 5,283,747 | A | * | 2/1994 | Komuro et al. | 700/138 |
| 5,319,565 | A | * | 6/1994 | Hausammann et al. | 700/131 |
| 5,357,442 | A | * | 10/1994 | Sekine | 700/137 |
| 5,379,226 | A | * | 1/1995 | Shigeta | 700/137 |

(Continued)

FOREIGN PATENT DOCUMENTS

JP 61-25397 B2 6/1986

(Continued)

*Primary Examiner*—Gary L. Welch
*Assistant Examiner*—Nathan E Durham
(74) *Attorney, Agent, or Firm*—Rothwell, Figg, Ernst & Manbeck PC

(57) ABSTRACT

Coordinates and a pen-stroke strength are input from a stylus. A section between the input coordinates is interpolated and needle fall points are determined such that the stitch width varies in accordance with the pen-stroke strength. Moreover, the stitch angle and the stitch density with respect to the stylus trace are input as parameters and used to determine the needle fall points. The determined stitch is displayed in real time.

17 Claims, 8 Drawing Sheets

U.S. PATENT DOCUMENTS

| | | | | | |
|---|---|---|---|---|---|
| 5,379,707 | A * | 1/1995 | Asano | 112/102.5 |
| 5,438,520 | A * | 8/1995 | Satoh et al. | 700/132 |
| 5,534,893 | A * | 7/1996 | Hansen et al. | 345/179 |
| 5,646,861 | A * | 7/1997 | Kotaki | 700/138 |
| 5,740,055 | A * | 4/1998 | Iwata | 700/139 |
| 5,740,056 | A * | 4/1998 | Futamura | 700/138 |
| 6,430,460 | B1 * | 8/2002 | Taguchi | 700/138 |
| 6,633,794 | B2 * | 10/2003 | Bailie | 700/138 |

FOREIGN PATENT DOCUMENTS

| | | | |
|---|---|---|---|
| JP | 3-85622 | A | 4/1991 |
| JP | 4-17891 | A | 1/1992 |
| JP | 5-161770 | A | 6/1993 |
| JP | 6-32722 | B2 | 5/1994 |
| JP | 6-34868 | B2 | 5/1994 |
| JP | 6-175771 | A | 6/1994 |
| JP | 6-296777 | A | 10/1994 |
| JP | 7-73340 | A | 3/1995 |
| JP | 8-112466 | A | 5/1996 |
| JP | 8-328724 | A | 12/1996 |
| JP | 9-10451 | A | 1/1997 |
| JP | 2596093 | B2 | 1/1997 |
| JP | 9-137360 | A | 5/1997 |
| JP | 2687461 | B2 | 8/1997 |
| JP | 2849719 | B2 | 11/1998 |
| JP | 11-486 | A | 1/1999 |
| JP | 11-114260 | A | 4/1999 |
| JP | 2982833 | B2 | 9/1999 |
| JP | 3016431 | B2 | 12/1999 |
| JP | 2002-273080 | A | 9/2002 |
| WO | WO 03/085186 | A | 10/2003 |

* cited by examiner

EMBROIDERY DATA CREATION DEVICE, EMBROIDERY DATA CREATION METHOD, AND EMBROIDERY DATA CREATION PROGRAM

CROSS REFERENCE TO RELATED APPLICATION

This application is a 35 USC § 371 National Phase Entry Application from PCT/JP2004/013108, filed Sep. 9, 2004, and designating the United States.

TECHNICAL FIELD

This invention relates to the creation of embroidery data, and more particularly to an embroidery data creation device, an embroidery data creation method, and an embroidery data creation program.

BACKGROUND ART

To create embroidery data, an image is read by a scanner or the like, and the embroidery data are created on the basis of the read image (Japanese Unexamined Patent Application Publication H8-112466, Japanese Unexamined Patent Application Publication H11-486). However, with this method it is only possible to convert the pre-existing image into embroidery data. As a result, it is difficult to create original embroidery data removed from pre-existing patterns and motifs.

DISCLOSURE OF THE INVENTION

A primary object of this invention is to enable an embroidery pattern to be drawn freely, and to enable real-time display of input embroidery stitches, or in other words to enable embroidery stitches to be displayed at substantially the same time as the embroidery data are input.

A secondary object of this invention is to provide a specific constitution for realizing the above object.

A secondary object of this invention is to increase the input freedom through drawing input means.

A secondary object of this invention is to make it possible to obtain beautiful embroidery at curved portions.

A secondary object of this invention is to prevent stiff embroidery caused by overlap of upper and lower embroidery stitches when an embroidery pattern overlaps.

A secondary object of this invention is to enable an immediate, realistic simulation of obtained embroidery data.

An embroidery data creation device of this invention is a device for creating embroidery needle fall point data, and comprises: drawing input means operated manually by a user for outputting at least a position thereof; a needle fall point processing unit for generating needle fall points along a trace constituted by a plurality of the positions input from the drawing input means, in parallel with the input of the trace and such that at least one of an embroidery stitch width, an embroidery stitch density, and an embroidery stitch angle in relation to the trace satisfies a predetermined condition; and display means for displaying an image of a stitch connecting the needle fall points in parallel with the input of the trace.

The drawing input means may employ a digitizer and a pen such as a stylus, as described in an embodiment, or may employ a mouse, track ball, joystick, or similar member instead. Needle fall point calculation and stitch image display are performed in parallel with trace input, or in other words without waiting for the completion of trace input. Preferably, when the trace of a single stroke is input, the needle fall points are calculated and the stitch image is displayed in parallel with input of the stroke. Alternatively, the needle fall points relating to a single stroke are calculated and the stitch image is displayed immediately after the stroke is input. When determining the stitch width, density, and angle in relation to the trace, for example, the stitch length and angle with respect to the trace may be determined in advance, whereupon the density is determined in accordance with the stitch length and angle such that the length and angle satisfy a predetermined condition. Alternatively, a visible outline defining the needle fall points may be set on either side of the trace, and the needle fall points may be determined at a predetermined density on the visible outline. In this case, the stitch length and angle are determined in accordance with the needle fall points. Note that in the embodiment, the length, trace-related angle, and density of each stitch are set so as to each satisfy a predetermined condition.

The needle fall point processing unit preferably determines an intermediate point by interpolating a section between the plurality of trace positions in accordance with the stitch density, and preferably determines the needle fall points on the basis of the intermediate point such that the stitch is set at a predetermined angle to the trace and a predetermined width. For example, the stitch is set to pass through the intermediate point at its central point or the like, or the needle fall points are determined on the basis of the intermediate point such that the needle fall points are located on a line extending diagonally or the like to the trace from the intermediate point.

Further, at least one type of data from a pressure applied by the user to the drawing input means, a movement velocity of the drawing input means, and an inclination of the drawing input means are preferably determined from the drawing input means, and at least one of the stitch width, the stitch density, and the stitch angle is corrected in accordance with the data. For example, assuming that the drawing input means takes the form of a pen, the pressure applied to the pen (pen-stroke strength), temporal variation in the pen position (movement velocity), the inclination from the vertical of the pen, and so on may be extracted as pen position data. Similar data may be extracted when the input means takes a different form to a pen, and by reflecting these data in the stitch width, stitch density, stitch angle from the trace, and so on, the freedom of input through the drawing input means increases.

Means for detecting a curved portion of the trace and means for inputting and storing a correction condition at the curved portion relating to at least one of the stitch width, the stitch density, and the stitch angle are preferably provided, and at least one of the stitch width, the stitch density, and the stitch angle is preferably corrected at the curved portion in accordance with the correction condition.

Means for storing an input order of the trace is preferably provided such that in an area where a plurality of traces overlap, the needle fall points of a trace having a predetermined input order are deleted. For example, the user may choose whether to delete the new or old needle fall points, or the deletion order may be fixed such that traces are deleted in order from the oldest trace, and so on.

Simulation means for simulating the determined stitch by applying at least a brightness level to the determined stitch is preferably provided, and it is particularly preferable that the simulation can be performed in real time, i.e. in parallel with the input of the trace. The simulation may apply the brightness level using a three-dimensional image of the stitch or a two-dimensional image of the stitch.

It is particularly preferable for the simulation means to comprise means for storing a light source direction, and to apply the brightness level to the stitch such that a side near to the stored light source direction is bright, a side far from the stored light source direction is dark, and the brightness level varies in monotone fashion along the stitch.

An embroidery data creation method of this invention is a method for creating embroidery needle fall point data, and comprises the steps of: generating needle fall points along a trace constituted by a plurality of positions input from drawing input means operated manually by a user, in parallel with the input of the trace and such that at least one of an embroidery stitch width, an embroidery stitch density, and an embroidery stitch angle in relation to the trace satisfies a predetermined condition; and displaying an image of a stitch connecting the needle fall points in parallel with the input of the trace by the drawing input means.

An embroidery data creation program of this invention comprises: a needle fall point generation command for generating needle fall points along a trace constituted by a plurality of positions input from drawing input means operated manually by a user, in parallel with the input of the trace and such that at least one of an embroidery stitch width, an embroidery stitch density, and an embroidery stitch angle in relation to the trace satisfies a predetermined condition; and a display command for displaying an image of a stitch connecting the needle fall points in parallel with the input of the trace by the drawing input means.

The embroidery data creation method and embroidery data creation program of this invention are basically identical to the embroidery data creation device, and in the absence of any indication to the contrary, description relating to the embroidery data creation device applies as is to the embroidery data creation method and embroidery data creation program.

In the embroidery data creation device, creation method, and creation program of this invention, the drawing input means are moved by a manual operation performed by a user, enabling the input of a plurality of positions which are connected to generate a trace. Needle fall points are determined in order to generate a stitch along the generated trace in real time during input of the trace and such that at least of the stitch density, width, and angle in relation to the trace satisfies a predetermined condition, and a stitch image is displayed immediately. Thus an embroidery pattern can be drawn freely using the drawing input means, and as a result, the embroidery image is not limited to a pre-existing image downloaded from a scanner or the like. When each position (each point) on the trace is input, calculation of the needle fall points can be started without waiting for the completion of trace input, and hence the needle fall points can be determined and the stitch image displayed in real time. As a result, embroidery design is made easy.

Here, an intermediate point is determined by interpolating the section between the positions of the trace, and the needle fall points are determined on the basis of the intermediate point such that the stitch has a predetermined angle and a predetermined width in relation to the trace. In so doing, the needle fall points can be determined at high velocity, in real time, and such that the width and angle take predetermined values.

By correcting the stitch width, density, or angle from the trace in accordance with the pressure applied to the drawing input means, the movement velocity thereof, the inclination thereof, and so on, an embroidery pattern can be drawn while correcting these parameters freely, and hence embroidery data input becomes even easier.

If the stitch width, density, and angle from the trace at a curved portion are identical to those at a straight line portion, it is impossible to obtain beautiful embroidery. Hence, a curved portion is detected from the trace, for example from the curvature of the trace or the like. Further, since it is difficult to obtain a uniform rule for the manner in which the stitch width, density, angle, and so on should be changed at a curved portion, correction conditions for these factors are input and stored, and the stitch width, density, angle, and so on are corrected at a curved portion in accordance with the correction conditions. In so doing, beautiful embroidery can be obtained easily even at curved portions.

When traces are input freely through the drawing input means, overlapping traces may occur. When the stitches of an old trace and the stitches of a new trace overlap in such an overlap area, rough, stiff embroidery is obtained. Hence, by storing the input order of the traces in advance, the stitches of either the new trace or the old trace can be removed from the overlapping portion easily. Note that since the remaining trace may be deleted, the data relating to the deleted stitches are preferably made restorable.

By simulating the input embroidery data with at least a brightness level applied to the stitch, an image of the embroidery data can be confirmed conveniently. When the simulation is performed in real time, embroidery design becomes particularly easy.

During the simulation, by ensuring that the light source direction does not only illuminate the stitch from directly above, leading to the acquisition of an image in which the center of the stitch is bright and the two ends thereof are dark, and instead generating an image in which one end of the stitch is bright and the other end is dark, the three-dimensional quality of the embroidery can be emphasized. Hence, by storing the light source direction and applying a brightness level to the stitch during the simulation such that the side nearest the stored light source direction is bright, the side farthest from the light source direction is dark, and the brightness level varies in monotone fashion along the stitch, a simulation image having a three-dimensional, relief quality is obtained.

BRIEF DESCRIPTION OF THE SYMBOLS

Figure 1:
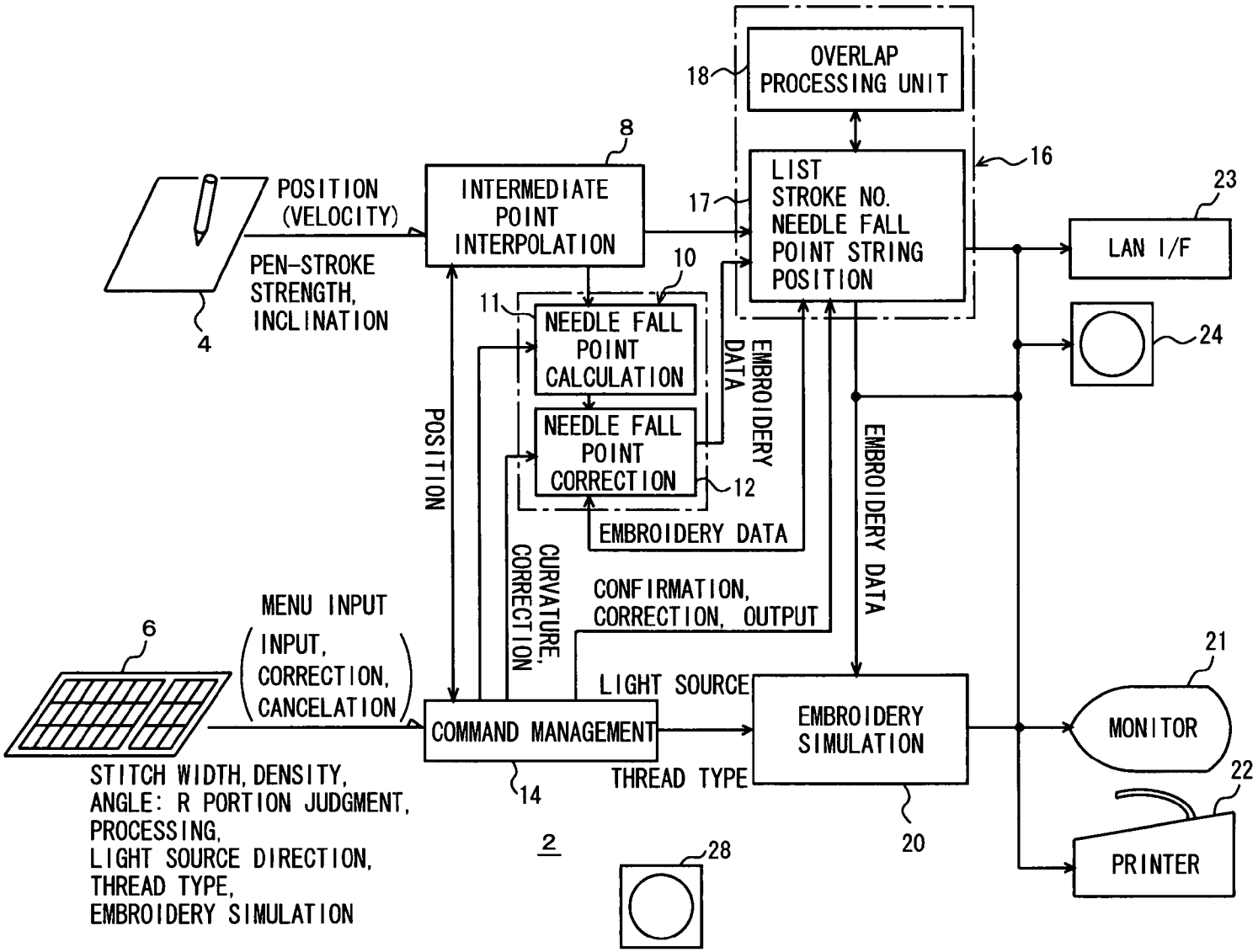
FIG. 1 is a block diagram of an embroidery data creation device according to an embodiment.

2 Embroidery data creation device
4 Drawing input unit
6 Command input unit
8 Intermediate point interpolation unit
10 Needle fall point processing unit
11 Needle fall point calculation unit
12 Needle fall point correction unit
14 Command management unit
16 Embroidery data storage unit
17 List
18 Overlap processing unit
20 Embroidery simulation unit
21 Monitor
22 Printer
23 LAN interface
24 Disk drive
28 Storage medium for storing embroidery data creation program
30 Embroidery data creation program
32 Needle fall point processing command
33 Interpolation command
34 Needle fall point calculation command
35 Curved portion detection command
36 Curved portion correction command
37 overlap portion processing command
40 User interface command
42 Embroidery simulation command
43 Brightness calculation command
44 Thread image creation command
50 Trace
51,52 Embroidery data
54-57 Embroidery data
60-62 Embroidery data
64 Thread
65 Knitting fabric
66-68 Embroidery simulation image

BEST MODE FOR CARRYING OUT THE INVENTION

A preferred embodiment for carrying out the present invention will now be described.

FIGS. 1 to 9 illustrate this embodiment. In these drawings, 2 is an embroidery data creation device, and 4 is a drawing input unit which here uses a combination of a stylus and a digitizer and outputs the position of the stylus at predetermined time intervals in the order of milliseconds. The pen-stroke strength and stylus inclination when a user moves the stylus manually are also output. The inclination may be determined according to the difference between the XY coordinates of the tip end of the stylus and the XY coordinates of the opposing base end of the stylus. Since the stylus outputs its position, pen-stroke strength, and inclination at predetermined time intervals, velocity is also determined according to position variation. The pen-stroke strength, velocity, and inclination are elements for applying expressiveness to the drawing input performed by the stylus, and it is possible to use only one of them, for example the pen-stroke strength. Further, a track ball, mouse, joystick, and so on may be used in the drawing input unit 4 instead of the stylus and digitizer.

6 is a command input unit which performs menu selection, parameter input, input of various commands, and so on using command and parameter input from a keyboard or an operation of a graphical user interface by the stylus and so on. During menu input, determinations as to whether to input, correct, or delete an embroidery pattern, whether to perform an embroidery simulation in parallel with the movement of the stylus, and so on are input, while during parameter input, the stitch width, stitch density, and stitch angle in relation to the trace are input. Further, curved portion (R portion) determination conditions, curved portion processing content, for example whether to reduce the stitch width or conversely increase the stitch width, whether to reduce the stitch density or conversely increase the stitch density, whether to increase or decrease the stitch angle in relation to the trace of the drawing input performed by the stylus or the like, and so on, are also input. When a plurality of strokes overlap or when overlap occurs within a single stroke (when a closed loop stroke or the like is input), user selections are input to indicate whether to delete the needle fall points relating to the old side trace or the needle fall points relating to the new trace in the overlapping part, and so on. Further, the light source direction, thread type, and so on are input as embroidery simulation parameters. The thread type may be specified as a thread image from a disk drive 24 or the like.

An intermediate point interpolation unit 8 determines the distance on a two-dimensional plane between positions of the stylus, which are input at predetermined time intervals from the drawing input unit 4, and interpolates an intermediate point of this distance in accordance with the stitch density. A needle fall point processing unit 10 comprises a needle fall point calculation unit 11 and a needle fall point correction unit 12 for correcting needle fall point data determined by the needle fall point calculation unit 11. In the needle fall point calculation unit 11, the aforementioned intermediate point serves as a center point of the stitch, for example, and the needle fall points are calculated such that the stitch width and the stitch angle in relation to the drawing input trace are set at predetermined values. Note that the stitch width, stitch density, or trace-related stitch angle are preferably corrected according to the pen-stroke strength applied to the drawing input unit 4 and so on, and that here, the stitch width is corrected according to the pen-stroke strength. In the needle fall point correction unit 12, the stitch width, angle, density, and so on at a curved portion are corrected. Here, the needle fall point calculation unit 11 calculates temporary needle fall points, whereupon the needle fall point correction unit 12 corrects the needle fall points at the curved portion, thereby correcting the stitch width. Calculation of the needle fall points need not be divided into two stages, and the needle fall points may be determined taking curved portion correction and the like into account from the start.

A command management unit 14 stores selected menus such as embroidery pattern input, correction, or deletion, embroidery simulation, and so on, and various input parameter values in accordance with input from the command input unit 6. For example, reference values of the stitch width, stitch density, and trace-related stitch angle are input as parameters from the command input unit 6 and stored, and commands such as whether to delete the needle fall points of the new or old trace when a plurality of traces overlap are also input from the command input unit 6 and stored. The command management unit 14 outputs these data to the intermediate point interpolation unit 8, which determines the intermediate point density. This information is then output to the needle fall point calculation unit 11, which determines the stitch width and stitch angle. The curved portion correction conditions are then output to the needle fall point correction unit 12, which performs needle fall point correction.

The obtained needle fall point data are stored in a list 17 of an embroidery data storage unit 16. A process extending from the designer picking up the stylus to putting it down again is set as a single stroke, and numbers are allocated to the strokes in order from old to new, for example, such that a string of needle fall point coordinates is stored for each stroke. When an area (embroidery area) defined by needle fall points overlaps in two or more strokes, an overlap processing unit 18 deletes the needle fall points of either the new or the old stroke from the overlap area.

The stroke to be deleted is determined according to the input order and so on, and selection of the stroke to be deleted is input through the command input unit 6 and so on. Likewise when overlap occurs within a single stroke, an order is determined from the string of needle fall point coordinates within the stroke. The section between the needle fall points on either side of a deleted needle fall point is connected by a stitch, and when the stitch is too long, a needle fall point may be added midway. When a needle fall point is deleted from an overlap area, the deleted needle fall point data are stored separately, for example, so that they can be restored. Embroidery data may be corrected or deleted by specifying the correction or deletion subject in stroke units or the like, for example, and during correction, the trace may be modified without modifying parameters such as the stitch width, density, and so on. Alternatively, parameters such as the stitch width, stitch density, trace-related stitch angle, and so on may be modified without modifying the trace.

An embroidery simulation unit 20 simulates the embroidery data using the light source direction (input through the command input unit 6) and thread type, which are stored in the command management unit 14, as well as a thread image and the needle fall point data (embroidery data), for example. 21 is a monitor which outputs embroidery data as an image representing an individual stitch every time embroidery data are input through the drawing input unit 4, or in other words every time a trace is input. Further, when embroidery simulation is selected through the command input unit 6, an embroidery simulation image is displayed in real time on the monitor 21 in parallel with the movement of the stylus. The stitch image and embroidery simulation image may be output from a printer 22. 23 is a LAN interface, and 24 is a disk drive. The embroidery data, embroidery simulation image, and so on may be output to a LAN, not shown in the drawing, and the disk drive 24. 28 is a storage medium for storing an embroidery data creation program, which enables storage of the embroidery data creation program in the embroidery data creation device 2 via the disk drive 24 and so on.

Figure 2:
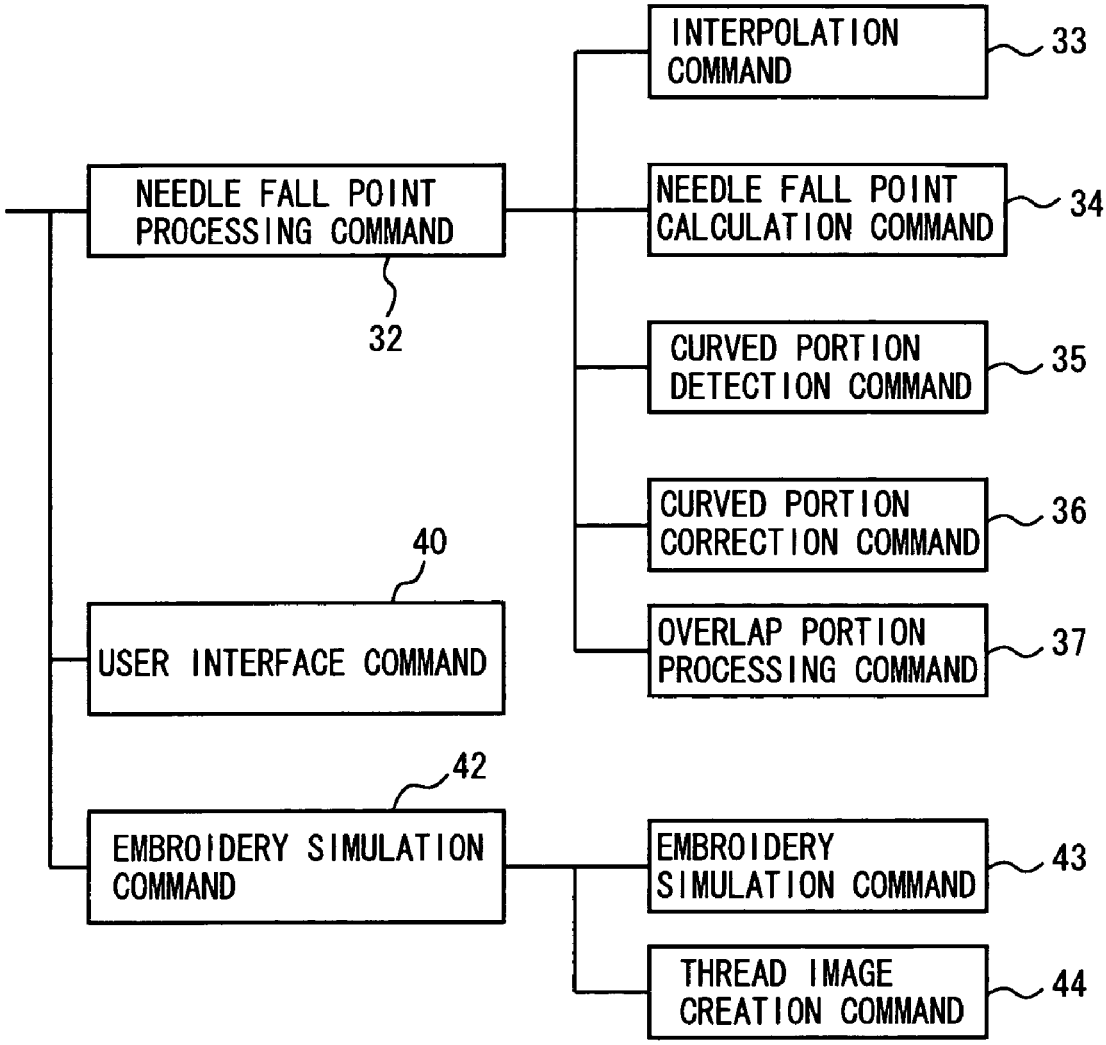
FIG. 2 is a block diagram showing the constitution of an embroidery data creation program according to this embodiment.
Figure 3:
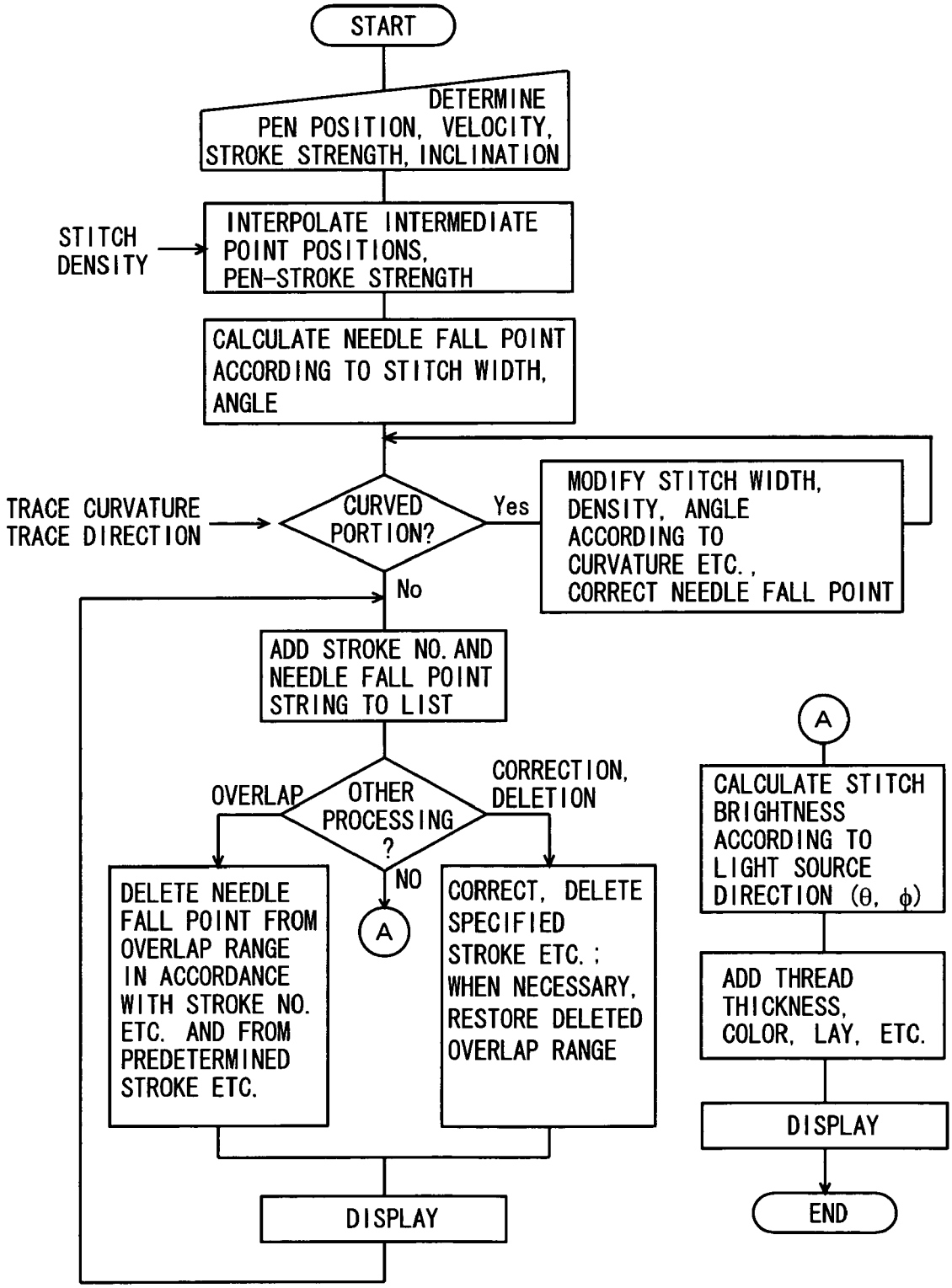
FIG. 3 is a flowchart illustrating an embroidery data creation method according to this embodiment.

FIG. 2 shows the content of the embroidery data creation program 30. A needle fall point processing command 32 calculates needle fall point data (XY coordinates) on the basis of input from the drawing input unit 4, and an interpolation command 33 interpolates an intermediate point between two positions input from the drawing input unit 4 in accordance with the stitch density. A needle fall point calculation command 34 calculates the needle fall points in accordance with the stitch width and trace-related stitch angle, which are input from the command input unit 6, and correction values relating to the stitch width and stitch angle, which are generated in accordance with the pen-stroke strength and so on. A curved portion detection command 35 detects a curved portion on the basis of the curvature of the trace input from the drawing input unit 4 and so on, and corrects the needle fall points such that at least one of the stitch width, stitch density, and stitch angle is modified in accordance with correction conditions obtained from a curved portion correction command 36. An overlap portion processing command 37 deletes the needle fall points of the old side stroke restorably from an overlapping embroidery area when trace overlap occurs.

A user interface command 40 stores and manages the menus and various parameters input from the command input unit 6. An embroidery simulation command 42 comprises a brightness calculation command 43 for calculating the brightness of the stitches on the basis of the light source orientation input from the command input unit 6, and a thread image creation command 44 for creating a thread image corresponding to the stitch length on the basis of the thread thickness, lay, and so on. The embroidery simulation command 42 synthesizes the thread image and brightness to perform an embroidery data simulation. Note that when the thread is considered as a simple rod-form member, the thread image creation command 44 is not required.

FIGS. 3 to 9 illustrate the embroidery data creation process in detail. Referring to the stylus simply as a pen, the pen position, velocity, pen-stroke strength, and inclination are determined at predetermined time intervals, the position of an intermediate point is determined in accordance with the stitch density, which is input from the command input unit 6, and the pen-stroke strength and so on are interpolated in relation to each intermediate point. Then, based on the stitch width and trace-related stitch angle input from the command input unit 6, the needle fall points are determined such that each intermediate point passes through the center of the stitch.

Figure 4:
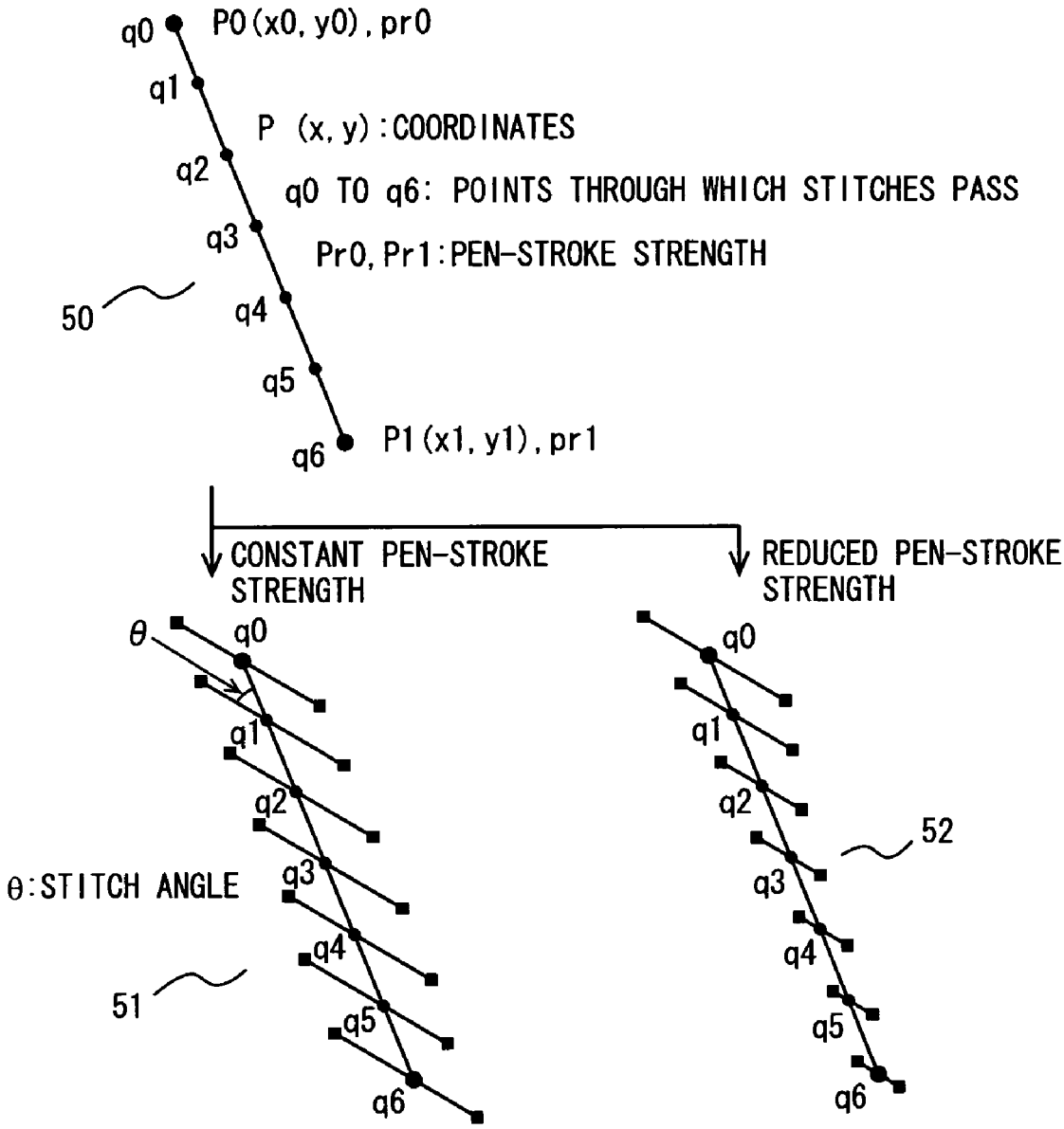
FIG. 4 is a view showing interpolation of an intermediate point from a pen trace, determination of the stitch width according to the pen-stroke strength, and determination of needle fall points according to the stitch angle and stitch width.
Figure 5:
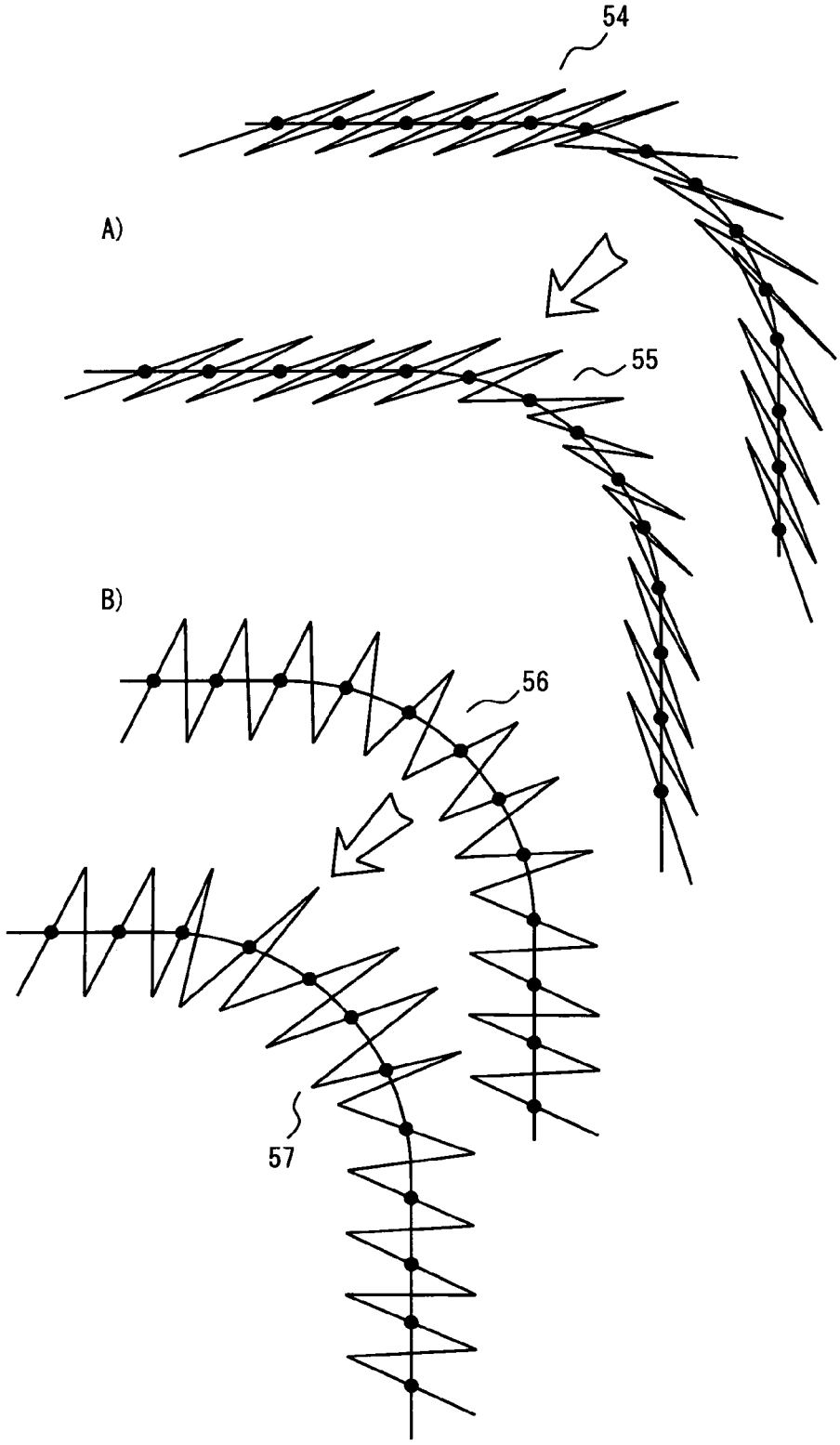
FIG. 5 is a view showing correction of the stitch width, stitch density, and stitch angle at a curved portion, A illustrating an example in which the stitch width is reduced at the curved portion, and B illustrating an example in which the stitch width is increased at the curved portion.

For example, in a trace 50 shown in FIG. 4, when the coordinates of a point P0 and a point P1 are input together with the pen-stroke strength, intermediate points q1 to q5 are interpolated on the basis of the stitch density, and the two end points P0, P1 are set as a point q0 and a point q6, respectively. When the pen-stroke strength is constant, for example, the needle fall points are calculated to obtain a predetermined angle θ and a predetermined width, and thus embroidery data 51 are obtained. In contrast, when the pen-stroke strength decreases from the point P0 to the point P1, for example, embroidery data 52 shown on the lower right side of FIG. 4, in which the stitch width gradually decreases, are obtained. Note that the effects allocated to the pen velocity, pen-stroke strength, and inclination are arbitrary, and in this embodiment, only the pen-stroke strength is used.

FIGS. 5A, 5B illustrate curved portion processing. In embroidery data 54 shown in FIG. 5A, for example, the trace-related stitch angle is small, and hence in this case, the stitch width is preferably shortened at the curved portion. The embroidery data 54 have not been corrected in relation to the curved portion, and hence the stitches overlap on the inside of the curve, giving the impression that the stitches protrude far from the curve on the outside of the curve. Embroidery data 55 have been subjected to curved portion correction, and accordingly the stitch width on the inside of the curved portion is reduced and the stitch width on the outside of the curved portion is slightly reduced.

Various processing may be applied at a curved portion, and FIG. 5B illustrates a case in which the trace-related stitch angle is large. In this case, uncorrected embroidery data 56 may be corrected to embroidery data 57, in which the stitch width is conversely increased at the curved portion. The type of correction that is applied at a curved portion corresponds to input from the command input unit 6. In this embodiment, the stitch width is modified at the curved portion, but the density, angle, and so on may be modified instead. Further, curved portions may be detected from variation in the trace direction, and correction may be increased as the curvature, corresponding to the rate of change in the trace direction, increases. Alternatively, a curved portion may be detected from the trace orientation and so on in relation to the X and Y directions (the width direction, length direction, and so on of the knitting fabric or cloth), and a trace that is diagonal to the X and Y directions may be determined as a curved portion, for example. Alternatively, an X direction trace or a Y direction trace may be considered as a curved portion. In this case, however, a predetermined direction, for example the XY direction, is set as a straight line and a diagonal direction to this direction is set as a curve, and hence it is difficult to input embroidery data freely.

Figure 6:
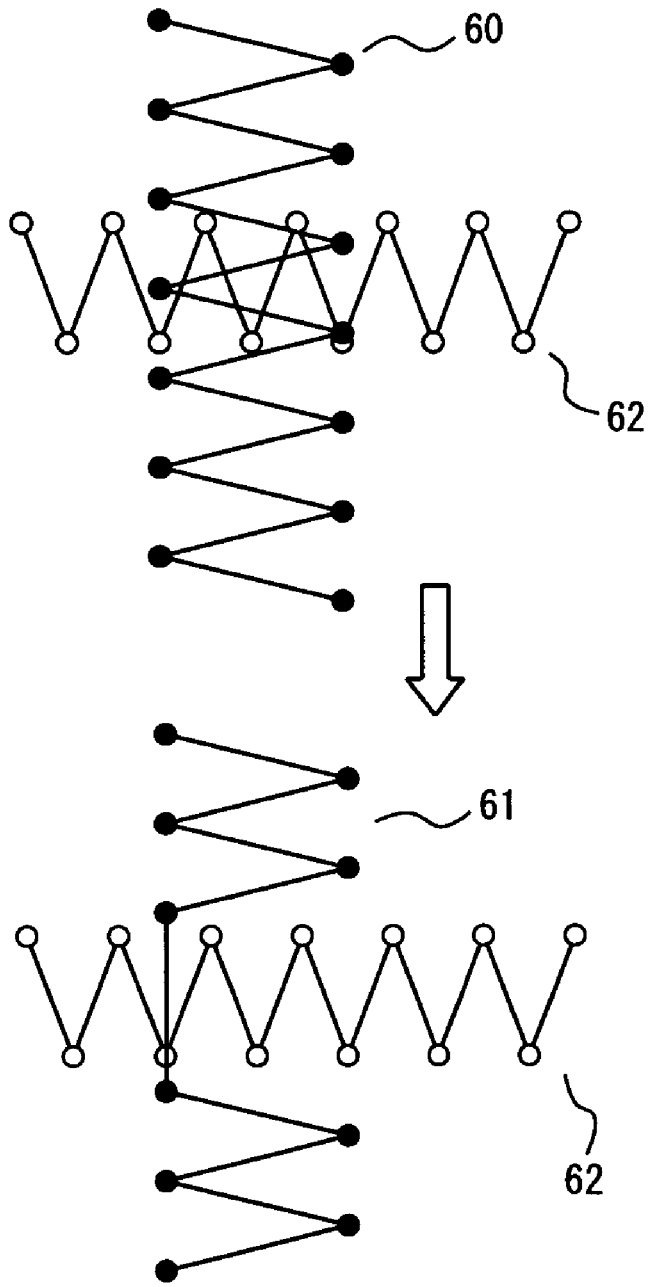
FIG. 6 is a view showing processing of a stroke overlap portion according to this embodiment.

FIG. 6 illustrates overlap portion processing assuming, for example, that old stroke embroidery data 60 and new stroke embroidery data 62 overlap. In this case, the old stroke stitches are deleted from the overlap area to obtain embroidery data 61. Note that the new embroidery data 62 may be deleted, and therefore the data relating to the stitches deleted from the embroidery data 60 are preferably stored separately. When a pre-existing image or the like is read by a scanner to generate the embroidery data, basically embroidery data overlap does not occur, but in this embodiment, free drawing is permitted through the drawing input unit 4, and hence this processing is required due to the possibility of embroidery area overlap.

Figure 7:
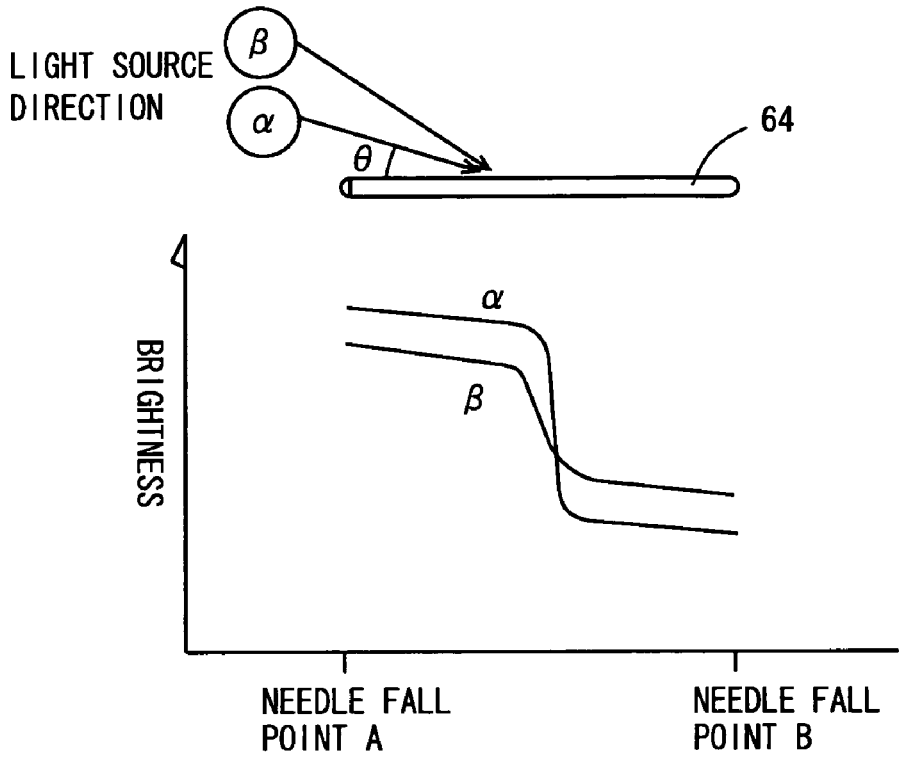
FIG. 7 is a view showing stitch brightness corresponding to a light source direction during an embroidery simulation.
Figure 8:
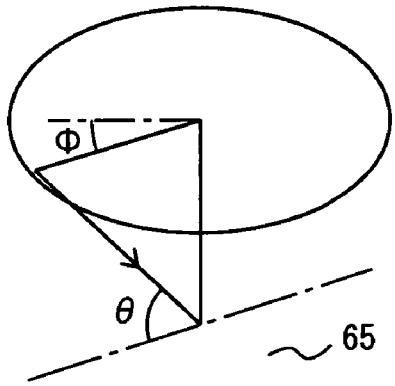
FIG. 8 is a view illustrating the meaning of the term "embroidery direction" according to this embodiment.
Figure 9:
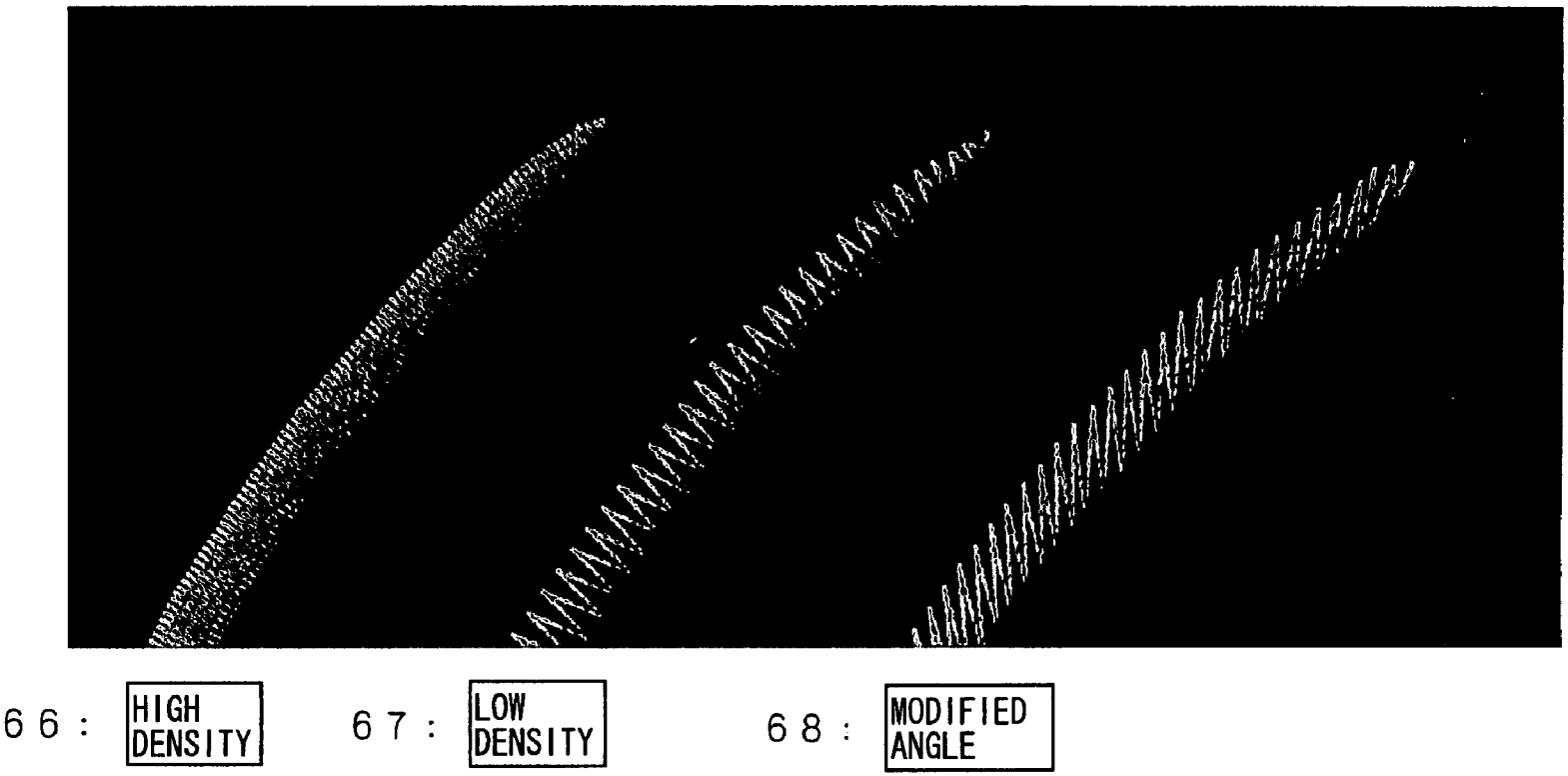
FIG. 9 is a view showing an embroidery simulation image according to this embodiment.

In parallel with trace input through the drawing input unit 4, intermediate point calculation and needle fall point determination are performed, and a stitch image is displayed on the monitor in real time and in parallel with the drawing input. The displayed image is an image of a plurality of stitches, and corresponds to the embroidery data 51, 52 shown in FIG. 4, for example. When an embroidery simulation is instructed through the command input unit 6, an embroidery simulation is performed as shown in FIGS. 7 to 9. The light source direction is input through the command input unit 6 and stored in the command management unit 14. FIG. 8 illustrates the meaning of the light source direction. As shown in FIG. 8, two types of data, i.e. the height ($\theta$) at which the light source or the like is oriented in relation to a two-dimensional plane constituted by knitting fabric 65, cloth, etc. and the orientation ($\phi$) of the light source or the like in relation to the width direction and length direction of the knitting fabric or cloth, are set as the light source direction. For simplicity, the light source may be assumed to be on the left side of the knitting fabric or cloth such that only the height need be specified.

64 in FIG. 7 denotes embroidery thread. When the light source height is low (light source position $\alpha$), the brightness on the left and right sides of the stitch is intense, and when the light source height is high ($\beta$), the stitch brightness weakens. The light source direction of the stitch is bright and the opposite direction thereto is dark, and hence the brightness varies in a substantially stepped form from one end of the stitch to the other. As a result, monotone brightness is obtained rather than the parabolic brightness that is obtained when the stitch is illuminated from directly above such that the center of the stitch is bright and the two sides are dark. In a typical embroidery simulation, the light source direction is often assumed to be directly above the knitting fabric or cloth such that the central portion of the stitches is light and the two end sides are dark. By allowing free specification of the light source direction and brightness application based thereon, as in this embodiment, a realistic simulation in which the stitches appear in relief can be performed.

FIG. 9 shows three types of embroidery simulation images 66 to 68. An image 66 shows a case in which the stitch density is high, 67 shows a case in which the density is low, and 68 shows a case in which the stitch angle has been reduced. Although not shown in the drawing, when the stitch angle is reduced to 30° or less in relation to the drawing input trace, for example, and the stitch width is increased, a unique embroidery style with a soft border along the trace can be obtained.

In the intermediate point interpolation unit, the center point of the stitch may be moved to the inside or outside of a curved portion of the trace, or the trace itself may be shifted to the inside or outside from the input value input through the drawing input unit. Further, when the stylus of the drawing input unit is moved slowly, the lines may become jagged due to shaking of the hand. To make the trace smooth in this case, the intermediate point interpolation unit may be provided with a spline conversion unit, a coordinate averaging unit, or the like such that the trace input through the drawing input means is subjected to spline conversion. Alternatively, when the distance between the coordinates read at predetermined time intervals is shorter than a predetermined value, the average value of the coordinates may be used to make the trace smooth.

The invention claimed is:

1. An embroidery data creation device for creating data of an embroidery stitch, comprising:

drawing input means operated manually by a user for outputting at least a position of the operation, the drawing input means obtaining at least one type of said data from a pressure applied by said user to said drawing input means, a movement velocity of said drawing input means, and an inclination of said drawing input means;

a needle fall point processing unit for generating a needle fall point along a trace constituted by a plurality of said positions input from said drawing input means, in accordance with said data, in parallel with an input of said trace, and such that at least one of an embroidery stitch width, an embroidery stitch density, and an embroidery stitch angle in relation to said trace satisfies a predetermined condition;

means for detecting a curved portion of said trace by determining a curvature of said trace;

means for inputting and storing a correction condition at said curved portion relating to at least one of said stitch width, said stitch density, and said stitch angle, wherein at least one of said stitch width, said stitch density, and said stitch angle is corrected at said curved portion in accordance with said correction condition such that the correction increases as said curvature increases; and display means for displaying an image of the stitch connecting said needle fall points in parallel with the input of said trace.

2. The embroidery data creation device of claim 1, characterized in that said pressure applied by said user to said drawing input means is used as said data.

3. The embroidery data creation device of claim 2, characterized in that said stitch width is reduced as said pressure decreases.

4. The embroidery data creation device of claim 1, characterized in that said stitch width is corrected in accordance with said correction condition.

5. The embroidery data creation device of claim 1, characterized in that said needle fall point processing unit determines an intermediate point by interpolating a section between said plurality of trace positions in accordance with said stitch density, and determines said needle fall points on the basis of said intermediate point such that said stitch is set at a predetermined angle to said trace and a predetermined width.

6. The embroidery data creation device of claim 1, further comprising means for storing an input order of said trace such that in an area where a plurality of traces overlap, said needle fall points of a trace having a predetermined input order are deleted.

7. The embroidery data creation device of claim 1, further comprising simulation means for simulating said determined stitch by applying at least a brightness level to said determined stitch.

8. The embroidery data creation device of claim 7, characterized in that said simulation means comprises means for storing a light source direction, and applies said brightness level to said stitch such that a side near to said stored light source direction is bright, a side far from said stored light source direction is dark, and said brightness level varies in monotone fashion along said stitch.

9. The embroidery data creation device of claim 1 further comprising means for storing said data of an embroidery stitch on a processor readable medium.

10. An embroidery data creation method for creating data of an embroidery stitch, comprising the steps of:

generating needle fall points along a trace constituted by a plurality of positions input from drawing input means operated manually by a user, in accordance with at least one type of the data from a pressure applied by said user to said drawing input means, a movement velocity of said drawing input means, and an inclination of said drawing input means, in parallel with the input of said trace, and such that at least one of an embroidery stitch width, an embroidery stitch density, and an embroidery stitch angle in relation to said trace satisfies a predetermined condition;

detecting a curved portion of said trace by determining a curvature of said trace;

storing a correction condition at said curved portion relating to at least one of said stitch width, said stitch density, and said stitch angle;

correcting at least one of said stitch width, said stitch density, and said stitch angle at said curved portion in accordance with said correction condition such that the correction increases as said curvature increases; and displaying an image of the stitch connecting said needle fall points in parallel with the input of said trace by said drawing input means.

11. The embroidery data creation method of claim 10, characterized in that said stitch width is reduced as said pressure applied by said user to said drawing input means decreases.

12. The embroidery data creation method of claim 10, characterized in that said stitch width is corrected in accordance with said correction condition.

13. The embroidery data creation method of claim 10 further comprising a step of storing said data of an embroidery stitch on a processor readable medium.

14. A computer-readable medium storing computer-executable instructions for embroidery data creation, by performing operations comprising:

generating needle fall points along a trace constituted by a plurality of positions input from drawing input means operated manually by a user, in accordance with at least one type of data from a pressure applied by said user to said drawing input means, a movement velocity of said drawing input means, and an inclination of said drawing input means, in parallel with the input of said trace, and such that at least one of an embroidery stitch width, an embroidery stitch density, and an embroidery stitch angle in relation to said trace satisfies a predetermined condition;

detecting a curved portion of said trace by determining a curvature of said trace;

storing a correction condition at said curved portion relating to at least one of said stitch width, said stitch density, and said stitch angle, and correcting at least one of said stitch width, said stitch density, and said stitch angle at said curved portion in accordance with said correction condition such that the correction increases as said curvature increases; and displaying an image of a stitch connecting said needle fall points in parallel with the input of said trace by said drawing input means.

15. The computer-readable medium storing computer-executable instructions for embroidery data creation of claim 14, wherein said stitch width is reduced as said pressure applied by said user to said drawing input means decreases.

16. The computer-readable medium storing computer-executable instructions for embroidery data creation of claim 14, wherein said stitch width is corrected in accordance with said correction condition.

17. The computer-readable medium storing computer-executable instructions for embroidery data creation of claim 14, further comprising executable instructions for storing data for said needle fall points on a processor readable medium.

* * * * *